US009676541B2

(12) United States Patent
Wada et al.

(10) Patent No.: US 9,676,541 B2
(45) Date of Patent: Jun. 13, 2017

(54) STORAGE CONTAINER

(71) Applicant: UNICHARM CORPORATION, Ehime (JP)

(72) Inventors: Kiyoshi Wada, Tokyo (JP); Terutaka Iwasaki, Tokyo (JP); Takeshi Bando, Ehime (JP); Takahiro Ueda, Ehime (JP)

(73) Assignee: Unicharm Corporation, Ehime (JP)

( * ) Notice: Subject to any disclaimer, the term of this patent is extended or adjusted under 35 U.S.C. 154(b) by 0 days.

(21) Appl. No.: 14/430,692

(22) PCT Filed: Sep. 25, 2013

(86) PCT No.: PCT/JP2013/005684
§ 371 (c)(1),
(2) Date: Mar. 24, 2015

(87) PCT Pub. No.: WO2014/050096
PCT Pub. Date: Apr. 3, 2014

(65) Prior Publication Data

US 2015/0217931 A1 Aug. 6, 2015

(30) Foreign Application Priority Data

Sep. 25, 2012 (JP) ..... 2012-211558

(51) Int. Cl.
*B65D 85/00* (2006.01)
*B65D 83/08* (2006.01)
(Continued)

(52) U.S. Cl.
CPC ..... *B65D 83/0805* (2013.01); *A47K 10/422* (2013.01); *B65D 43/02* (2013.01);
(Continued)

(58) Field of Classification Search
USPC ..... 206/494, 440, 205, 207, 210, 761, 765
See application file for complete search history.

(56) References Cited

U.S. PATENT DOCUMENTS 3,446,395 A 5/1969 Ballin
4,796,411 A 1/1989 Kimura et al.
(Continued)

FOREIGN PATENT DOCUMENTS

JP H02-28232 7/1990
JP H03-66214 10/1991
(Continued)

OTHER PUBLICATIONS

International Search Report from corresponding PCT application No. PCT/JP2013/005684 dated Dec. 24, 2013 (4 pgs).
(Continued)

*Primary Examiner* — Jacob K Ackun
(74) *Attorney, Agent, or Firm* — Brinks Gilson & Lione

(57) ABSTRACT

A storage container which allows a user to easily take out sheets from a dispensing opening when the number of sheets is small. A storage container includes: a container body including a top plate where a dispensing opening for taking out the sheets is provided, and an opening formed opposing the top plate; and a bottom lid which is formed of an integrally-molded resin, is detachably mounted to the container body, and closes the opening. The bottom lid includes: a flat plate portion; and an expanding/contracting part transformable from a first state where it protrudes from the flat plate portion up to a first height toward the inside of the container body, to a second state where it protrudes from the flat plate portion up to a second height higher than the first height, toward the inside of the container body.

5 Claims, 5 Drawing Sheets

(51) Int. Cl.

| | |
|---|---|
| ***A47K 10/42*** | (2006.01) |
| ***B65D 43/02*** | (2006.01) |
| *A47K 10/32* | (2006.01) |

(52) U.S. Cl.
CPC ..... *A47K 2010/3233* (2013.01); *A47K 2010/3266* (2013.01); *B65D 2543/00305* (2013.01)

(56) References Cited

U.S. PATENT DOCUMENTS

| | | | | | |
|---|---|---|---|---|---|
| 5,531,325 | A * | 7/1996 | Deflander | A47K 10/20 | 206/494 |
| 5,699,912 | A * | 12/1997 | Ishikawa | A47K 10/421 | 206/494 |
| 6,206,221 | B1 | 3/2001 | Bando et al. | | |
| 7,621,420 | B2 * | 11/2009 | Bandoh | B65D 43/164 | 206/494 |
| 7,681,725 | B2 * | 3/2010 | Mueller | B65D 75/5833 | 206/210 |
| 2002/0017522 | A1 | 2/2002 | Bando et al. | | |
| 2006/0027468 | A1 * | 2/2006 | Berar | B65D 83/0805 | 206/210 |
| 2013/0153593 | A1 * | 6/2013 | Silagy | B65D 83/0817 | 221/1 |

FOREIGN PATENT DOCUMENTS

| | | |
|---|---|---|
| JP | H04-1110 | 1/1992 |
| JP | 11-79214 | 3/1999 |
| JP | 11-165777 | 6/1999 |
| JP | 11-180460 | 7/1999 |
| JP | 2001-198516 A | 7/2001 |
| JP | 2002-53157 A | 2/2002 |
| JP | 2009-125011 | 6/2009 |
| JP | 2012-162313 | 8/2012 |
| JP | 2012-176790 | 9/2012 |

OTHER PUBLICATIONS

European extended Search Report from corresponding European application No. 13840810.9 dated May 9, 2016.

* cited by examiner

STORAGE CONTAINER

RELATED APPLICATION

This application is a 35 U.S.C. §371 national phase filing of International Patent Application No. PCT/JP2013/005684, filed Sep. 25, 2013, through which and to which priority is claimed under 35 U.S.C. §119 to Japanese Patent Application No. 2012-211558, filed Sep. 25, 2012, the complete disclosure of which are hereby expressly incorporated herein by reference.

TECHNICAL FIELD

The present invention relates to a storage container for containing sheets such as wet tissues.

BACKGROUND ART

As a storage container for hermetically containing wet tissues, there has been widely used a container formed of a resin, and having a dispensing opening for taking out sheets, and an openable/closable top lid. When using the wet tissues, the top lid is opened to expose the dispensing opening, and some wet tissues are pulled out one by one from the dispensing opening. After the wet tissues have been taken out, the top lid is closed to hermetically close the dispensing opening again, thereby to suppress drying of the remaining wet tissues.

CITATION LIST

Patent Literature

[Patent Literature 1] Japanese Laid-Open Patent Publication No. 11-79214

[Patent Literature 2] Japanese Laid-Open Patent Publication No. 11-180460

SUMMARY OF THE INVENTION

Problems to be Solved by the Invention

When the number of the remaining wet tissues inside the storage container becomes small as the wet tissues have been used, a user needs to insert fingers deep into the container from the dispensing opening to pick out a wet tissue, which causes a problem of poor usability.

Therefore, an object of the present invention is to provide a storage container which, even when the number of sheets contained therein is small, allows a user to easily take out the sheets.

Solution to the Problems

A storage container according to the present invention includes: a container body including a top plate in which a dispensing opening for taking out the sheets is provided, and an opening formed at a position opposing the top plate; and a bottom lid which is formed of an integrally-molded resin, is detachably mounted to the container body, and closes the opening of the container body. The bottom lid includes: a flat plate portion; and an expanding/contracting part which is transformable from a first state where the expanding/contracting part protrudes from the flat plate portion up to a first height toward an inner side of the container body, to a second state where the expanding/contracting part protrudes from the flat plate portion up to a second height higher than the first height, toward the inner side of the container body.

Advantageous Effects of the Invention

According to the present invention, a storage container is provided in which a bottom part thereof can be raised up by increasing the height of an expanding/contracting part of a bottom plate, which allows a user to easily take out sheets from a dispensing opening even when the number of stored sheets is small.

DESCRIPTION OF EMBODIMENTS

Best Mode for Carrying Out the Invention

First, a fundamental structure of a storage container according to an embodiment will be described.

Figure 1:
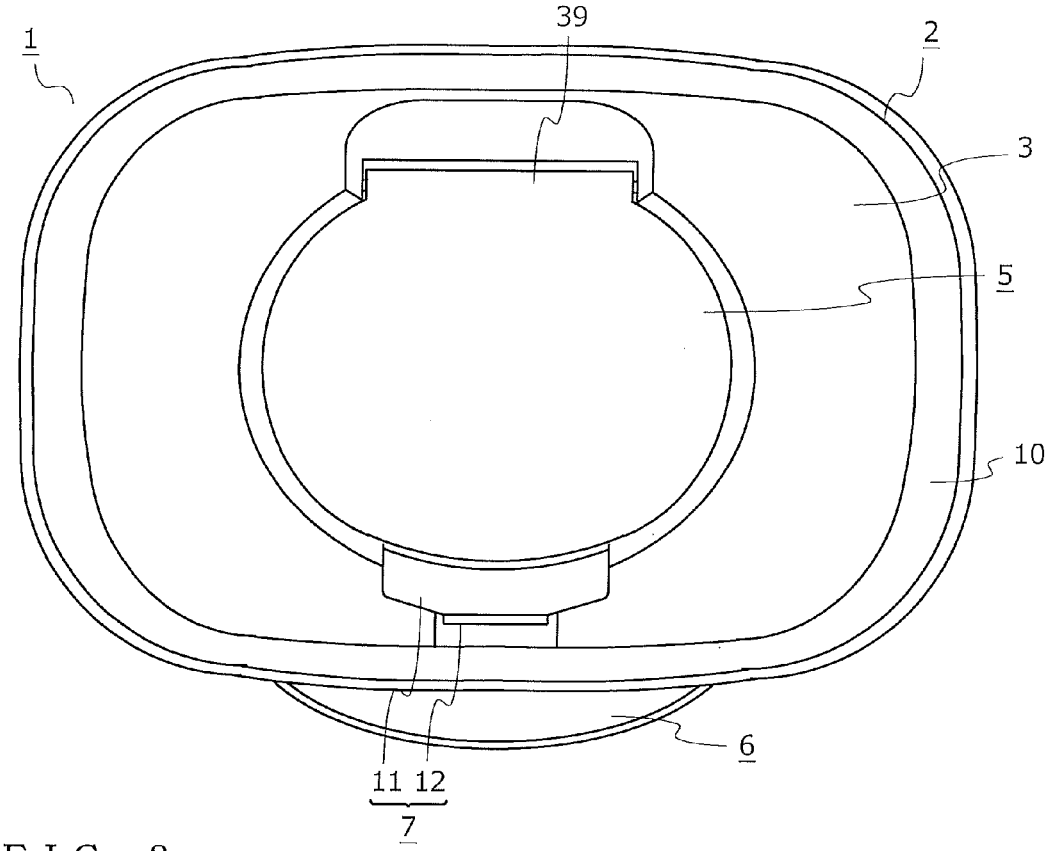
FIG. 1 is a plan view of a storage container according to an embodiment.
Figure 2:
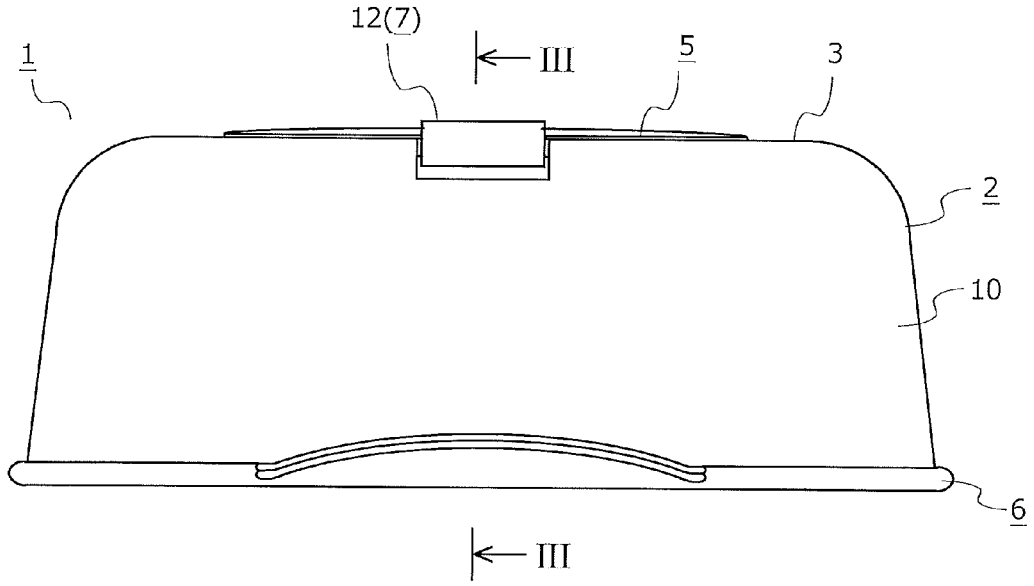
FIG. 2 is a front view of the storage container according to the embodiment.
Figure 3:
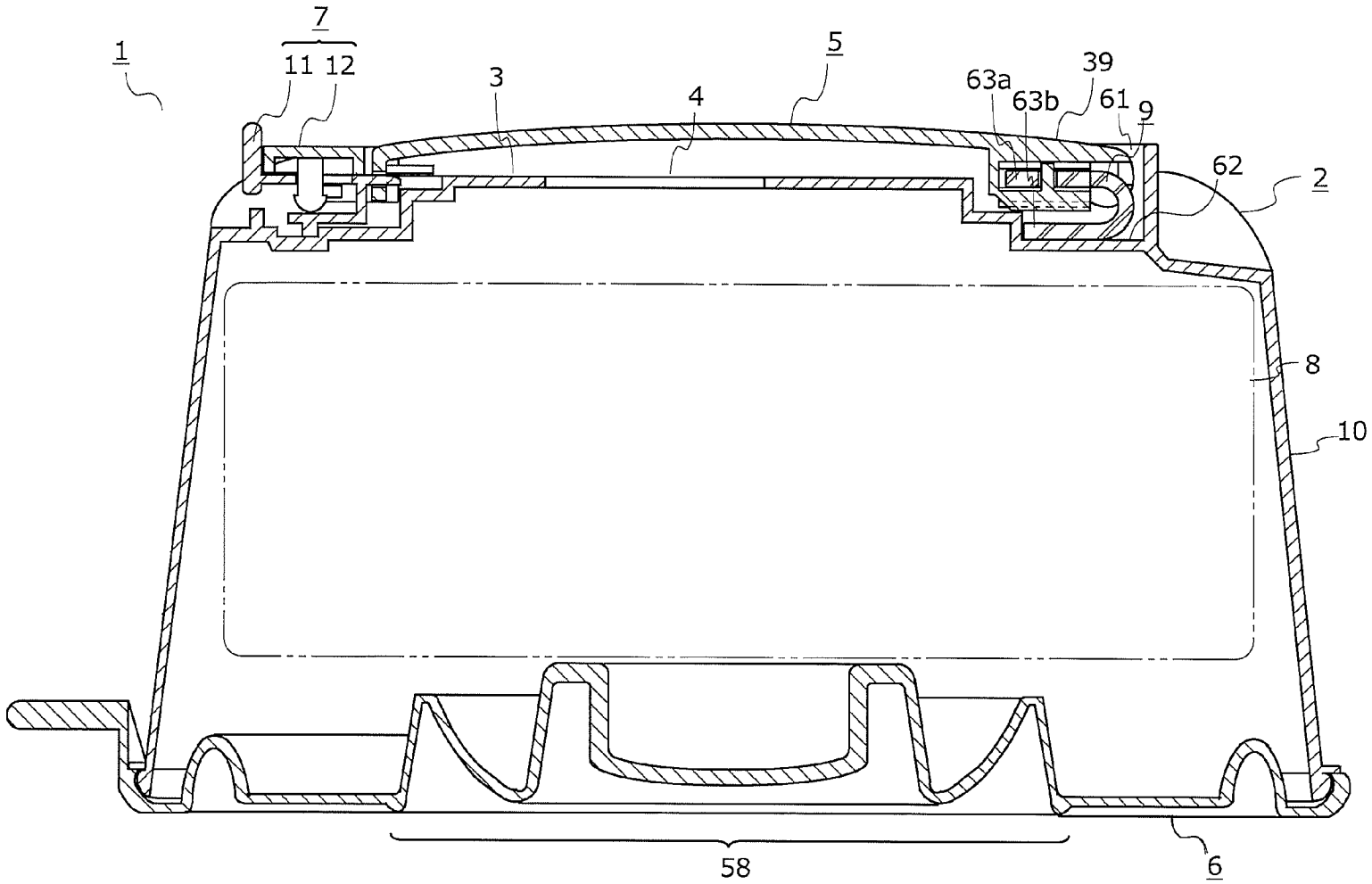
FIG. 3 is a cross-sectional view taken along a III-III line shown in FIG. 2.

FIG. 1 is a plan view of the storage container according to the embodiment. FIG. 2 is a front view of the storage container according to the embodiment. FIG. 3 is a cross-sectional view taken along a III-III line shown in FIG. 2.

The storage container 1 includes a container body 2, a top lid 5, a rubber plate 9, a push button structure 7, and a bottom lid 6. The storage container 1 hermetically contains stacked sheets. The sheets are, for example, wet sheets such as wet tissues, cleansing sheets, baby wipes, and the like. However, the sheets are not necessarily wet, and may be dry sheets such as tissue papers. As shown by an alternate long and two short dashes line in FIG. 3, the sheets may be stored as a package 8. That is, the sheets may be packaged in a pouch having, at its upper surface, an opening for taking out the sheets. Alternatively, the sheets may be directly stored without being packaged in a pouch or the like.

The container body 2 is a hollow box-shaped member for containing the package of sheets, and is integrally resin-molded. The container body 2 includes a top plate 3, and a peripheral wall 10 connected to an outer periphery of the top plate 3. The top plate 3 includes a dispensing opening 4 for taking out the sheets. The dispensing opening 4 is an opening or a slit having any shape, and the shape and size thereof can be optionally selected, taking into consideration ease of taking out the sheets, and sealing performance. A portion of the sheet container body 2, which opposes the top plate 3, that is, a bottom portion of the container body 2, is opened.

The top lid 5 is a member which is mounted to the container body 2 so as to be openable and closable, and in the closed state, closes the dispensing opening 4 provided at the top plate 3 of the container body 2. The top lid 5 is integrally resin-molded. The top lid 5 includes a mounting member 39 rotatable about a predetermined rotation shaft, and is mounted to the container body 2 via the mounting member 39.

The rubber plate 9 is a member for urging the top lid 5 in an open direction. As shown in FIG. 3, one end 63*a* of the rubber plate 9 is mounted to the top lid 5 while the other end 63*b* of the rubber plate 9 is housed in a recess 61 provided in the top plate 3 of the container body 2. More specifically, when the top lid 5 is in the closed state, the rubber plate 9 is bent in a U-shape, and an outer surface of the end 63*b* of the rubber plate 9 is in contact with a bottom surface 62 of the recess 61. Since a repelling force is caused by that the rubber plate 9 is elastically transformed in a U-shape when the top lid 5 is in the closed state, the top lid 5 can be urged in the open direction. The material of the rubber plate 9 is not particularly limited as long as it is elastically transformable. For example, silicone rubber may be used. Instead of the rubber plate 9, a plate spring made of a metal or resin may be used.

As shown in FIG. 1, the push button structure 7 is provided along an outer periphery of the top lid 5, at a position opposing the mounting member 39 of the top lid 5. The push button structure 7 is composed of a push button member 11, and a lock member 12 fitting the push button member 11. When being engaged with the top lid 5, the push button structure 7 maintains the top lid 5 to be in the closed state. In addition, when receiving a pressing force from a finger of a user who tries to open the top lid 5, the push button structure 7 cancels the engagement state with the top lid 5.

The bottom lid 6 is a member which is detachably mounted to the bottom portion of the container body 2, and closes the opening opposed to the top plate 3. The bottom lid 6 is integrally resin-molded. As shown in FIG. 3, the bottom lid 6 includes an expanding/contracting part 58 having a bellows-shaped cross section. The height of the expanding/contracting part 58 is variable when receiving a pressing force.

Hereinafter, the bottom lid will be described in detail with reference to FIGS. 1 to 6.

Figure 4:
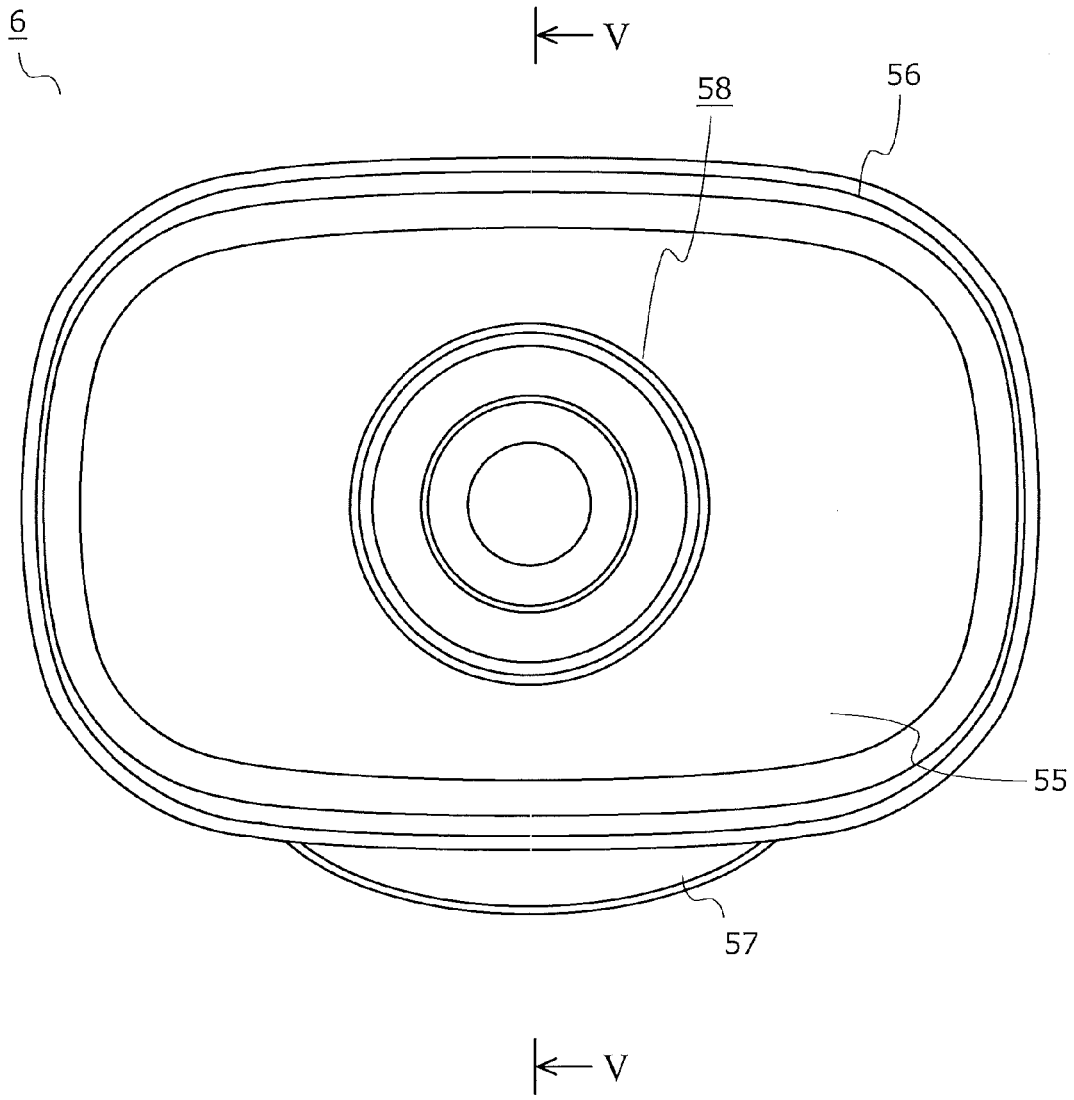
FIG. 4 is a plan view of a bottom lid shown in FIG. 1.
Figure 5:
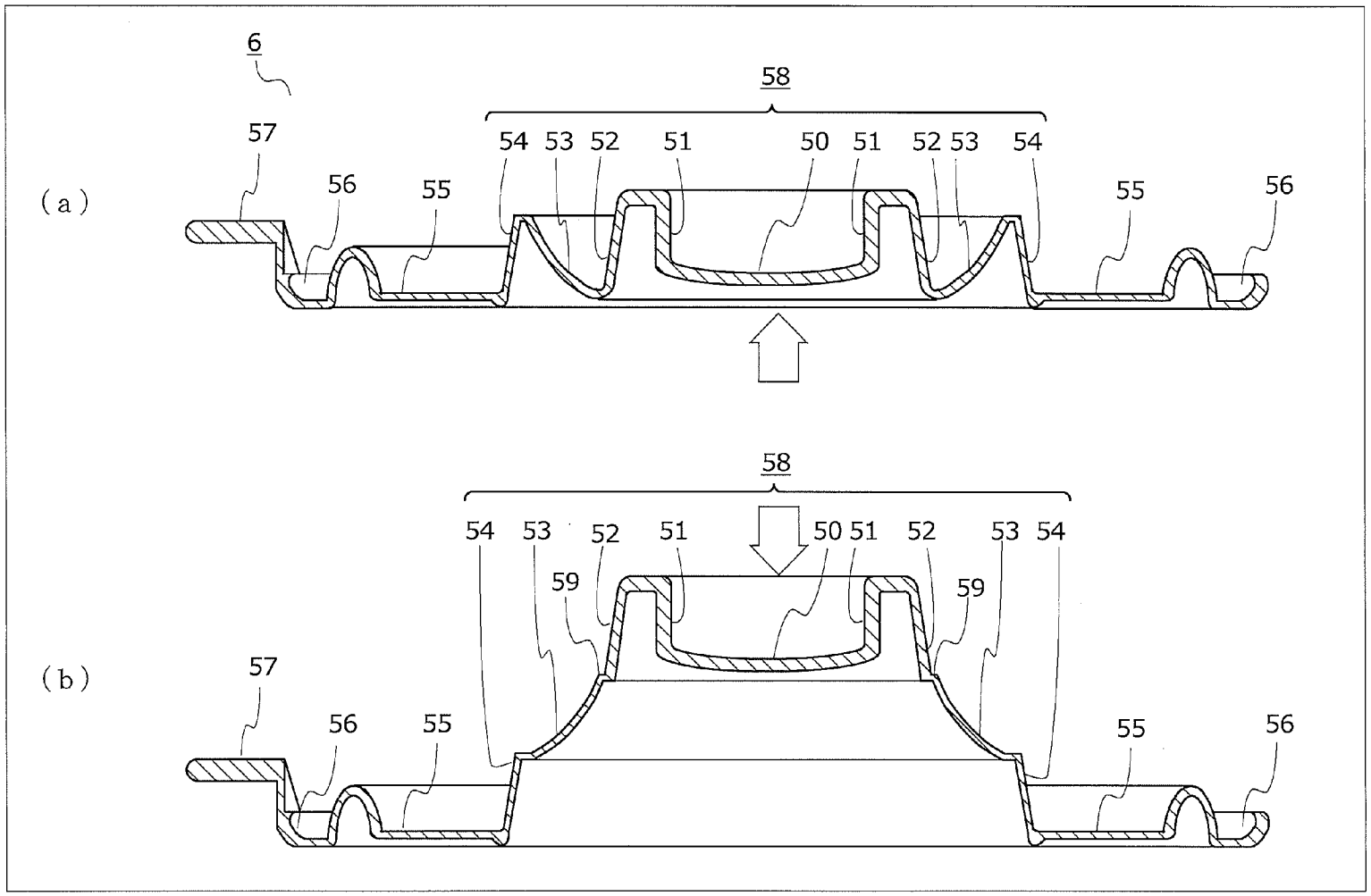
FIG. 5 is a cross-sectional view taken along a V-V line shown in FIG. 4.

FIG. 4 is a plan view of the bottom lid shown in FIG. 1. FIG. 5 is a cross-sectional view taken along a V-V line shown in FIG. 4. FIG. 5(*a*) shows a first state of the expanding/contracting part, and FIG. 5(*b*) shows a second state of the expanding/contracting part.

The bottom lid 6 includes a flat plate portion 55, the expanding/contracting part 58, a fitting portion 56, and a handle 57. The bottom lid 6 is integrally molded of a soft resin that is transformable by a pressing force applied by hand. As a material of the bottom lid 6, low density polyethylene may be used, for example. Since neither a slit nor an opening is provided in the bottom lid 6, the opening of the container body 2 can be hermetically closed. Therefore, when wet sheets such as wet tissues are contained in the container body 2, drying or the like of the sheets can be suppressed by closing the top lid 5.

The flat plate portion 55 is a flat portion provided around the expanding/contracting part 58.

The expanding/contracting part 58 is provided at almost the center of the flat plate portion 55. The expanding/contracting part 58 is configured to be transformable from the first state where it protrudes up to a first height toward the inner side of the container body 2, to the second state where it protrudes up to a second height higher than the first height, from the flat plate portion 55 toward the inner side of the container body 2. More specifically, the expanding/contracting part 58 is composed of an almost circular bottom surface portion 50, a first peripheral wall portion 51, a second peripheral wall portion 52, a third peripheral wall portion 53, and a fourth peripheral wall portion 54.

The bottom surface portion 50 has a curved shape protruding to the outer side of the container body 2 (downward in FIG. 5). The bottom surface portion 50 is a portion to be pressed by a finger or the like when the expanding/contracting part 58 is transformed from the first state to the second state.

The first peripheral wall portion 51 is formed so as to be connected to an outer periphery of the bottom surface portion 50 and rise up toward the inner side of the container body 2.

The second peripheral wall portion 52 is formed so as to surround the first peripheral wall portion 51. The second peripheral wall portion 52 is connected to a peripheral portion of the first peripheral wall portion 51 on the inner side of the container body 2 via a bent portion.

The third peripheral wall portion 53 is formed so as to surround the second peripheral wall portion 52 in the first state of the expanding/contracting part 58. The third peripheral wall portion 53 is connected to a peripheral portion of the second peripheral wall portion 52 on the outer side of the container body 2 via a bent portion. In addition, the third peripheral wall portion 53 has an outer diameter and an inner diameter that are gradually reduced from the inner side of the container body 2 toward the outer side thereof, and has a curved shape expanding toward the outer side of the container body 2.

The fourth peripheral wall portion 54 is formed so as to surround the third peripheral wall portion 53 in the first state of the expanding/contracting part 58. The fourth peripheral wall portion 54 is connected to a peripheral portion of the third peripheral wall portion 53 on the inner side of the container body 2, and is connected to the flat plate portion 55.

The fitting portion 56 is formed so as to surround the periphery of the flat plate portion 55. As shown in FIG. 5 the fitting portion 56 has an almost C-shaped cross section so that the peripheral of the bottom portion of the container body 2 can be fitted therein. By fitting the periphery of the bottom portion of the container body 2 in the fitting portion 56, the bottom lid 6 can be detachably mounted to the container body 2.

The handle 57 is formed so as to protrude outward from a part of the fitting portion 56. The handle 57 allows the user to easily hold the bottom lid 6 when the user detaches the bottom lid 6 to refill the container body 2 with sheets.

A description is now given of a method of transforming the expanding/contracting part 58 configured as described above, between the first state and the second state. Transformation of the expanding/contracting part 58 from the first state to the second state may be performed in either of the state where the bottom lid 6 is mounted to the container body 2 or the state where the bottom lid 6 is dismounted from the container body 2. Transformation of the expanding/contracting part 58 from the second state to the first state is performed in the state where the bottom lid 6 is dismounted from the container body 2.

First, when the expanding/contracting part 58 is to be transformed from the first state shown in FIG. 5(*a*) to the second state shown in FIG. 5(*b*), the user applies, with a finger or the like, a pressing force in a direction of an arrow shown in FIG. 5(*a*) to the outer surface of the bottom surface portion 50 located in the center of the expanding/contracting part 58, while holding the periphery of the bottom lid 6 or the container body 2. The pressing force applied to the bottom surface portion 50 pushes up the bottom surface portion 50, the first peripheral wall portion 51, the second peripheral wall portion 52, and the third peripheral wall portion 53 toward the inner side of the container body 2. Thereby, as shown in FIG. 5(*b*), the third peripheral wall portion 53 is inverted with a connection portion between the second peripheral wall portion 52 and the third peripheral wall portion 53 and a connection portion between the third peripheral wall portion 53 and the fourth peripheral wall portion 54 as supporting points. In other words, the connection portion between the second peripheral wall portion 52 and the third peripheral wall portion 53 is raised up toward the inner side of the container body 2. Thus, by pushing up the bottom surface portion 50 toward the inner side of the container body 2, the expanding/contracting part 58 is expanded and transformed to the second state where the expanding/contracting part 58 protrudes up to the second height, as shown in FIG. 5(*b*). After the transformation, the expanding/contracting part 58 is not spontaneously restored to the first state but is retained in the second state.

The shape of the upper surface of the bent portion connecting the second peripheral wall portion 52 and the third peripheral wall portion 53 is determined so that the connection portion between the second peripheral wall portion 52 and the third peripheral wall portion 53 forms an annular flat surface 59 when the expanding/contracting part 58 is transformed to the second state. Since, in the second state, the connection portion between the second peripheral wall portion 52 and the third peripheral wall portion 53 forms the annular flat surface 59, even when expansion and contraction of the expanding/contracting part 58 are repeatedly performed, occurrence of crack in this portion is suppressed. In order to effectively suppress such crack, the width of the annular flat surface 59 formed in the second state is preferably 1.0 mm or more.

Next, when expanding/contracting part 58 is to be transformed from the second state shown in FIG. 5(*b*) to the first state shown in FIG. 5(*a*), the user applies, with a hand or the like, a pressing force in a direction of an arrow shown in FIG. 5(*b*) to the connection portion between the first peripheral wall portion 51 and the second peripheral wall portion 52, while holding the outer surface of the bottom lid 6. The pressing force applied to the first peripheral wall portion 51 and the second peripheral wall portion 52 pushes down the bottom surface portion 50, the first peripheral wall portion 51, the second peripheral wall portion 52, and the third peripheral wall portion 53. Thereby, as shown in FIG. 5(*a*), the third peripheral wall portion 53 is again inverted with the connection portion between the second peripheral wall portion 52 and the third peripheral wall portion 53 and the connection portion between the third peripheral wall portion 53 and the fourth peripheral wall portion 54 as supporting points. Thus, by pushing down the connection portion between the first peripheral wall portion 51 and the second peripheral wall portion 52, the expanding/contracting part 58 is contracted and restored to the first state where the expanding/contracting part 58 protrudes up to the first height, as shown in FIG. 5(*a*). Further, since the third peripheral wall portion 53 has the curved shape expanding to the outer side of the container body 2, the third peripheral wall portion 53 is not wrinkled in the first state, resulting in a simple appearance.

In order to facilitate the transformation of the expanding/contracting part 58, the third peripheral wall portion 53 is preferably formed to be thinner than the bottom surface portion 50 and the first peripheral wall portion 51. For example, the thicknesses of the bottom surface portion 50 and the first peripheral wall portion 51 are 0.7 to 1.0 mm, and the thickness of the third peripheral wall portion 53 is 0.5 to 0.8 mm. The thicknesses of the second peripheral wall portion 52 and the fourth peripheral wall portion 54 are not particularly limited as long as the shapes thereof can be retained.

Figure 6:
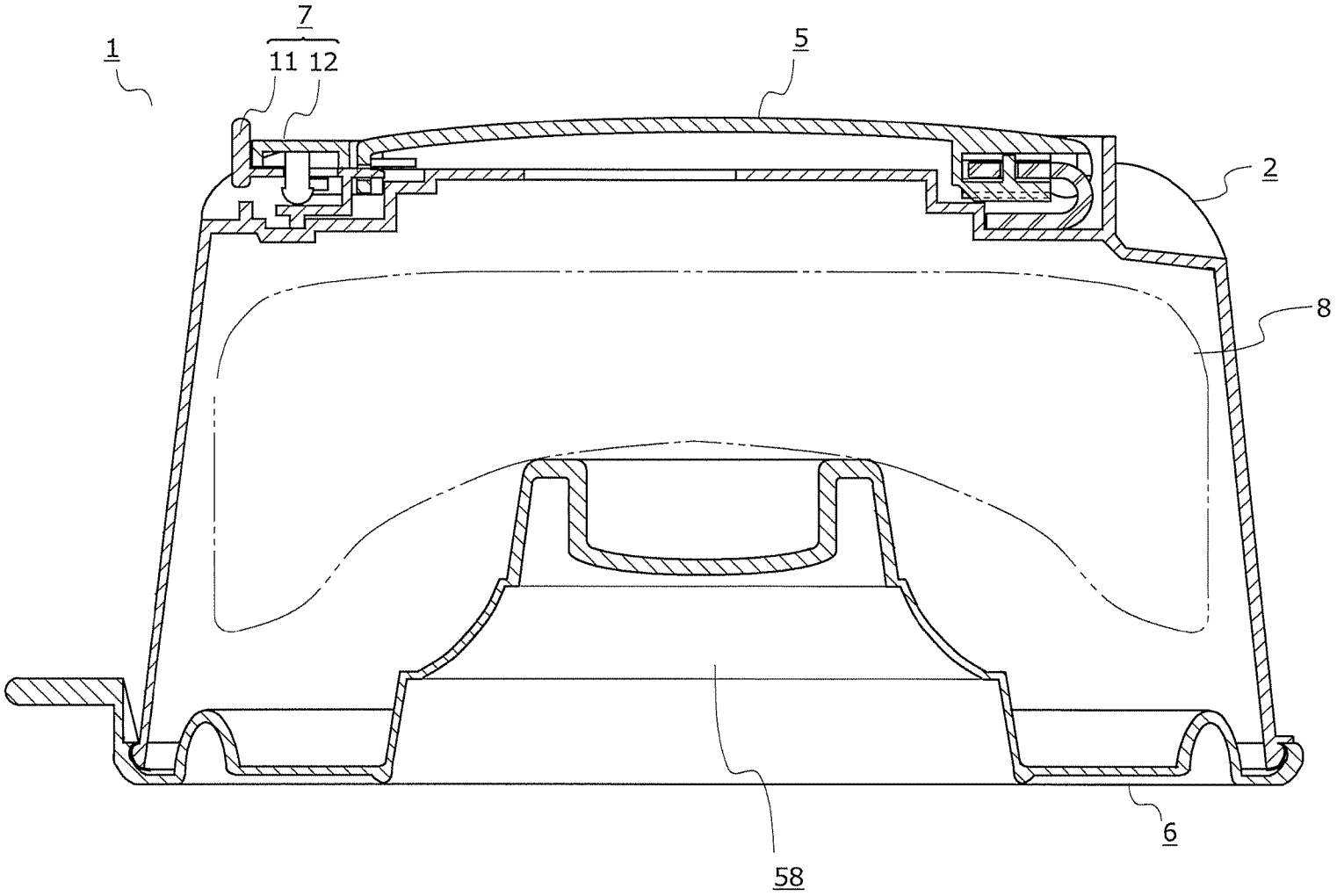
FIG. 6 is a cross-sectional view showing a state where the storage container according to the embodiment is used.

FIG. 6 is a cross-sectional view showing a state where the storage container according to the embodiment is used. FIG. 6 shows a cross-sectional view corresponding to FIG. 3.

When the sheets contained in the container body 2 have been used and the number of remaining sheets becomes small, the user needs to insert fingers deep into the container body 2 to pick up a sheet, which makes the sheets difficult to be taken out. According to the storage container 1 of the present embodiment, the bottom of the storage container 1 can be raised up as shown in FIG. 6 by expanding the expanding/contracting part 58 provided at the bottom lid 6 to the second state. When all the sheets in the container body 2 have been used up, the user can fill the storage container 1 with a new package 8 containing a large number of sheets, by causing the expanding/contracting part 58 to contract to the first state.

Therefore, according to the present invention, it is possible to realize the storage container 1 which allows the user to easily take out sheets even when the number of remaining sheets becomes small. In addition, since neither a slit nor an opening is formed in the bottom lid 6, the expanding/contracting part 58 is transformable between the first state and the second state without deteriorating the sealing performance of the bottom lid 6. Therefore, it is possible to maintain the container body 2 in the hermetically-sealed state, regardless of the transformation state of the expanding/contracting part 58.

Further, since the outer surface of the bottom surface portion 50 is a curved surface protruding to the outer side of the container body 2, the user can easily push the bottom surface portion 50 to transform the expanding/contracting part 58, resulting in improved usability.

In the bottom lid 6 according to the present embodiment, between the first peripheral wall portion 51 and the second peripheral wall portion 52, a plurality of ribs connecting these wall portions may be further provided. In this case, since the rigidities of the first peripheral wall portion 51 and the second peripheral wall portion 52 are increased, transformation of the first peripheral wall portion 51 and the second peripheral wall portion 52 can be suppressed when the expanding/contracting part 58 is expanded and contracted.

Further, in the present embodiment, the bottom surface portion 50 constituting the expanding/contracting part 58 has an almost circuit shape, and the first peripheral wall portion 51, the second peripheral wall portion 52, the third peripheral wall portion 53, and the fourth peripheral wall portion 54 are concentric with the bottom surface portion 50. However, the shape of the bottom surface portion 50 and the shapes of the peripheral wall portions surrounding the bottom surface portion 50 may be other than concentric circles.

INDUSTRIAL APPLICABILITY

The present invention is applicable to a resin-made storage container which hermetically contains sheets, particularly, wet sheets such as wet tissues.

DESCRIPTION OF THE REFERENCE CHARACTERS

1 storage container
2 container body

3 top plate
4 dispensing opening
5 top lid
6 bottom lid
50 bottom surface portion
51 first peripheral wall portion
52 second peripheral wall portion
52 third peripheral wall portion
54 fourth peripheral wall portion
55 flat plate portion
58 expanding/contracting part
59 flat surface

The invention claimed is:

1. A storage container for containing sheets, comprising:

a container body including a top plate in which a dispensing opening for taking out the sheets is provided, and an opening formed at a position opposing the top plate; and a bottom lid which is formed of an integrally-molded resin, is detachably mounted to the container body, and closes the opening of the container body, wherein the bottom lid includes:

a flat plate portion; and an expanding/contracting part which is transformable from a first state where the expanding/contracting part protrudes from the flat plate portion up to a first height toward an inner side of the container body, to a second state where the expanding/contracting part protrudes from the flat plate portion up to a second height higher than the first height, toward the inner side of the container body; and wherein the expanding/contacting part includes:

a bottom surface portion;

a first peripheral wall portion that rises up from an outer periphery of the bottom surface portion toward the inner side of the container body;

a second peripheral wall portion that surrounds the first peripheral wall portion, and is connected to a peripheral portion of the first peripheral wall portion on the inner side of the container body;

a third peripheral wall portion that, in the first state, surrounds the second peripheral wall portion, and is connected to a peripheral portion of the second peripheral wall portion on an outer side of the container body; and a fourth peripheral wall portion that, in the first state, surrounds the third peripheral wall portion, and is connected to a peripheral portion of the third peripheral wall portion on the inner side of the container body and to the flat plate portion, wherein the expanding/contracting part is transformed to the second state by inverting the third peripheral wall portion with a connection portion between the third peripheral wall portion and the fourth peripheral wall portion as a supporting point, according to a pressing force, toward the inner side of the container body, applied to the bottom surface portion, and in the first state, the third peripheral wall portion has an inner diameter and an outer diameter that are gradually reduced toward the outer side of the container body, and a curved shape expanding toward the outer side of the container body.

2. The storage container according to claim 1, wherein the bottom lid hermetically closes the opening of the container body.

3. The storage container according to claim 1, wherein the third peripheral wall portion has a thickness of 0.5 to 0.8 mm.

4. The storage container according to claim 1, wherein in the second state, the connection portion between the second peripheral wall portion and the third peripheral wall portion forms an annular flat surface that is substantially parallel to the flat plate portion, and the flat surface has a width equal to or larger than 1 mm.

5. The storage container according to claim 1, wherein a surface of the bottom surface portion on the outer side of the container body is a convex surface.

* * * * *